US010513761B2

(12) United States Patent
Kobayashi et al.

(10) Patent No.: US 10,513,761 B2
(45) Date of Patent: Dec. 24, 2019

(54) HIGH-STRENGTH STEEL MATERIAL FOR OIL WELL AND OIL COUNTRY TUBULAR GOODS

(71) Applicant: NIPPON STEEL & SUMITOMO METAL CORPORATION, Tokyo (JP)

(72) Inventors: Kenji Kobayashi, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 222 days.

(21) Appl. No.: 15/513,306

(22) PCT Filed: Sep. 28, 2015

(86) PCT No.: PCT/JP2015/077301
§ 371 (c)(1),
(2) Date: Mar. 22, 2017

(87) PCT Pub. No.: WO2016/052397
PCT Pub. Date: Apr. 7, 2016

(65) Prior Publication Data

US 2017/0306462 A1 Oct. 26, 2017

(30) Foreign Application Priority Data

Oct. 1, 2014 (JP) ..... 2014-203076

(51) Int. Cl.

| | |
|---|---|
| ***C22C 38/38*** | (2006.01) |
| ***C22C 38/00*** | (2006.01) |
| ***C21D 6/00*** | (2006.01) |
| ***C21D 8/02*** | (2006.01) |
| ***C21D 8/10*** | (2006.01) |
| ***C21D 9/46*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/26*** | (2006.01) |
| ***C22C 38/32*** | (2006.01) |
| ***C22C 38/04*** | (2006.01) |
| ***C22C 38/24*** | (2006.01) |

(52) U.S. Cl.
CPC ..... *C22C 38/38* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/105* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/32* (2013.01); *C21D 8/02* (2013.01); *C21D 8/10* (2013.01)

(58) Field of Classification Search
CPC ..... C22C 38/38
See application file for complete search history.

(56) References Cited

U.S. PATENT DOCUMENTS

| | | | | |
|---|---|---|---|---|
| 4,377,422 | A | 3/1983 | Mackay et al. | |
| 2008/0035249 | A1 | 2/2008 | Scott et al. | |
| 2011/0308673 | A1 | 12/2011 | Schneider et al. | |
| 2014/0261918 | A1 | 9/2014 | Jin et al. | |
| 2014/0373588 | A1* | 12/2014 | Lee | C22C 38/002 72/200 |

FOREIGN PATENT DOCUMENTS

| | | |
|---|---|---|
| CN | 1846002 | 10/2006 |
| EP | 0692548 | 1/1996 |
| FR | 2068283 | 8/1971 |
| JP | 51-092718 | 8/1976 |
| JP | 55-104428 | 8/1980 |
| JP | 59-232220 | 12/1984 |
| JP | 60-36647 | 2/1985 |
| JP | 60-39150 | 2/1985 |
| JP | 60-039150 | 2/1985 |
| JP | 61-009519 | 1/1986 |
| JP | 63-093822 | 4/1988 |
| JP | 06-057379 | 3/1994 |
| JP | 06-145899 | 5/1994 |
| JP | 06-184700 | 7/1994 |
| JP | 09-249940 | 9/1997 |
| JP | 10-121202 | 5/1998 |
| JP | 10-121204 | 5/1998 |
| JP | 2013-023743 | 2/2013 |

(Continued)

*Primary Examiner* — Jophy S. Koshy
(74) *Attorney, Agent, or Firm* — Clark & Brody

(57) ABSTRACT

There is provided a high-strength steel material for oil well having a chemical composition consisting, by mass percent, of C: 0.70-1.8%, Si: 0.05-1.00%, Mn: 12.0-25.0%, Al: 0.003-0.06%, P: ≤0.03%, S: ≤0.03%, N: ≤0.10%, V: >0.5% and ≤2.0%, Cr: 0-2.0%, Mo: 0-3.0%, Cu: 0-1.5%, Ni: 0-1.5%, Nb: 0-0.5%, Ta: 0-0.5%, Ti: 0-0.5%, Zr: 0-0.5%, Ca: 0-0.005%, Mg: 0-0.005%, B: 0-0.015%, the balance: Fe and impurities, satisfying [0.6≤C-0.18V-0.06Cr<1.44], wherein a metal micro-structure is consisting essentially of an austenite single phase, V carbides having circle equivalent diameters of 5 to 100 nm exist at a number density of 20 pieces/$\mu m^2$ or higher, and a yield strength is 654 MPa or higher.

4 Claims, 1 Drawing Sheet

(56) References Cited

FOREIGN PATENT DOCUMENTS

| | | | | |
|---|---|---|---|---|
| RU | 2007131590 | | 2/2009 | |
| RU | 2354716 | | 5/2009 | |
| RU | 2524027 | | 7/2014 | |
| WO | WO-2013100612 | A1 * | 7/2013 | ..... C22C 38/002 |
| WO | 2013/191131 | | 12/2013 | |

* cited by examiner

HIGH-STRENGTH STEEL MATERIAL FOR OIL WELL AND OIL COUNTRY TUBULAR GOODS

TECHNICAL FIELD

The present invention relates to a high-strength steel material for oil well and oil country tubular goods, and more particularly, to a high-strength steel material for oil well excellent in sulfide stress cracking resistance, which is used in oil well and gas well environments and the like environments containing hydrogen sulfide ($H_2S$) and oil country tubular goods using the same.

BACKGROUND ART

In oil wells and gas wells (hereinafter, collectively referred simply as "oil wells") of crude oil, natural gas, and the like containing $H_2S$, sulfide stress-corrosion cracking (hereinafter, referred to as "SSC") of steel in wet hydrogen sulfide environments poses a problem, and therefore oil country tubular goods excellent in SSC resistance are needed. In recent years, the strengthening of low-alloy sour-resistant oil country tubular goods used in casing applications has been advanced.

The SSC resistance deteriorates sharply with the increase in steel strength. Therefore, conventionally, steel materials capable of assuring SSC resistance in the environment of NACE solution A (NACE TM0177-2005) containing 1-bar $H_2S$, which is the general evaluation condition, have been steel materials of 110 ksi grade (yield strength: 758 to 862 MPa) or lower. In many cases, higher-strength steel materials of 125 ksi grade (yield strength: 862 to 965 MPa) and 140 ksi grade (yield strength: 965 to 1069 MPa) can only assure SSC resistance under a limited $H_2S$ partial pressure (for example, 0.1 bar or lower). It is thought that, in the future, the corrosion environment will become more and more hostile due to larger depth of oil well, so that oil country tubular goods having higher strength and higher corrosion resistance must be developed.

The SSC is a kind of hydrogen embrittlement in which hydrogen generated on the surface of steel material in a corrosion environment diffuses in the steel, and resultantly the steel material is ruptured by the synergetic effect with the stress applied to the steel material. In the steel material having high SSC susceptibility, cracks are generated easily by a low load stress as compared with the yield strength of steel material.

Many studies on the relationship between metal micro-structure and SSC resistance of low-alloy steel have been conducted so far. Generally, it is said that, in order to improve SSC resistance, it is most effective to turn the metal micro-structure into a tempered martensitic structure, and it is desirable to turn the metal micro-structure into a fine grain structure.

For example, Patent Document 1 proposes a method which refines the crystal grains by applying rapid heating means such as induction heating when the steel is heated. Also, Patent Document 2 proposes a method which refines the crystal grains by quenching the steel twice. Besides, for example, Patent Document 3 proposes a method which improve the steel performance by making the structure of steel material bainitic. All of the object steels in many conventional techniques described above each have a metal micro-structure consisting mainly of tempered martensite, ferrite, or bainite.

The tempered martensite or ferrite, which is the main structure of the above-described low-alloy steel, is of a body-centered cubic system (hereinafter, referred to as a "BCC"). The BCC structure inherently has high hydrogen embrittlement susceptibility. Therefore, for the steel whose main structure is tempered martensite or ferrite, it is very difficult to prevent SSC completely. In particular, as described above, SSC susceptibility becomes higher with the increase in strength. Therefore, it is said that to obtain a high-strength steel material excellent in SSC resistance is a problem most difficult to solve for the low-alloy steel.

In contrast, if a highly corrosion resistant alloy such as stainless steel or high-Ni alloy having an austenitic structure of a face-centered cubic system (hereinafter, referred to as an "FCC"), which inherently has low hydrogen embrittlement susceptibility, is used, SSC can be prevented. However, the austenitic steel generally has a low strength as is solid solution treated. Also, in order to obtain a stable austenitic structure, usually, a large amount of expensive component element such as Ni must be added, so that the production cost of steel material increases remarkably.

Manganese is known as an austenite stabilizing element. Therefore, the use of austenitic steel containing much Mn as a material for oil country tubular goods in place of expensive Ni has been considered. Patent Document 4 discloses a steel that contains C: 1.2% or less, Mn: 5 to 45%, and the like and is strengthened by cold working. Also, Patent Document 5 discloses a technique in which a steel containing C: 0.3 to 1.6%, Mn: 4 to 35%, Cr: 0.5 to 20%, V: 0.2 to 4%, Nb: 0.2 to 4%, and the like is used, and the steel is strengthened by precipitating carbides in the cooling process after solid solution treatment. Further, Patent Document 6 discloses a technique in which a steel containing C: 0.10 to 1.2%, Mn: 5.0 to 45.0%, V: 0.5 to 2.0%, and the like is subjected to aging treatment after solid solution treatment, and the steel is strengthened by precipitating V carbides.

LIST OF PRIOR ART DOCUMENTS

Patent Document

Patent Document 1: JP61-9519A
Patent Document 2: JP59-232220A
Patent Document 3: JP63-93822A
Patent Document 4: JP10-121202A
Patent Document 5: JP60-39150A
Patent Document 6: JP9-249940A

DISCLOSURE OF THE INVENTION

Problems to be Solved by the Invention

Since the austenitic steel generally has a low strength, in Patent Document 4, a yield stress a bit larger than 100 $kgf/mm^2$ is attained by performing cold working of 40% working ratio. However, the result of study conducted by the present inventors revealed that, in the steel of Patent Document 4, $\alpha'$ martensite is formed by strain induced transformation due to the increase in degree of cold working, and the SSC resistance is sometimes deteriorated. Also, there will be a problem of lacking an ability of a rolling mill with the increase in degree of cold working, so that there remains room for improvement.

In contrast, Patent Documents 5 and 6 intend to strengthen a steel by a precipitation of carbides. Precipitation strengthening by aging dispenses with the need of increasing the performance of cold rolling equipment. Therefore, austenitic steels, in which a stable austenite structure can be maintained even after precipitation strengthening by aging, can be promising in view of SSC resistance.

The evaluation of the SSC resistance of a steel material for oil well is relatively frequently carried out with a constant load test (e.g., NACE TM0177-2005 Method A). However, in recent years, evaluations based on DCB test (e.g., NACE TM0177-2005 Method D) have been emphasized.

In particular, when an austenitic steel is subjected to transformation into a BCC structure such as an α' martensite by strain induced transformation, the deterioration of SSC resistance remarkably occurs. In an austenitic steel, strain induced transformation may possibly occur in a stress concentrating zone in the vicinity of a crack front end. Also from such a viewpoint, SSC resistance evaluation by DCB test, which uses a test specimen in which a defect portion is included in advance, is particularly important for austenitic steels.

In Patent Documents 5 and 6, the SSC resistance evaluation by DCB test has not been performed, and there are concerns about SSC resistance in a stress concentrating zone such as the vicinity of a crack front end.

An object of the present invention is to provide a precipitation-strengthened high-strength steel material for oil well that exhibits an excellent SSC resistance (a calculated value of $K_{ISSC}$ is large) in DCB test, has a yield strength of 95 ksi (654 MPa) or higher, and has a general corrosion resistance as much as those of low-alloy steels.

Means for Solving the Problems

The present inventors conducted SSC resistance evaluation using DCB test, and conducted studies of a method for obtaining a steel material for which the problems with prior art are overcome, and which has an excellent SSC resistance in DCB test and a high yield strength. As the result, the present inventors came to obtain the following findings.

(A) To improve SSC resistance in DCB test, a steel material is required to contain a large amount of C and Mn, which are austenite phase stabilizing elements, more specifically, to contain 0.7% or more of C and 12% or more of Mn.

(B) To precipitation-strengthen a steel material, it is effective to utilize V carbides. For this reason, the steel material is required to contain more than 0.5% of V.

(C) In contrast, a V consumes a dissolved C, making an austenite unstable. In addition, in order to stabilize an austenite, it is desired to avoid coexistence with excessive Cr. For this reason, it is required that the amount of effective C expressed by C-0.18V-0.06Cr is 0.6% or more.

The present invention has been accomplished on the basis of the above-described findings, and involves the high-strength steel material for oil well and oil country tubular goods described below.

(1) A high-strength steel material for oil well having a chemical composition consisting, by mass percent, of C: 0.70 to 1.8%,
Si: 0.05 to 1.00%,
Mn: 12.0 to 25.0%,
Al: 0.003 to 0.06%,
P: 0.03% or less,
S: 0.03% or less,
N: 0.10% or less,
V: more than 0.5% and 2.0% or less,
Cr: 0 to 2.0%,
Mo: 0 to 3.0%,
Cu: 0 to 1.5%,
Ni: 0 to 1.5%,
Nb: 0 to 0.5%,
Ta: 0 to 0.5%,
Ti: 0 to 0.5%,
Zr: 0 to 0.5%,
Ca: 0 to 0.005%,
Mg: 0 to 0.005%,
B: 0 to 0.015%,
the balance: Fe and impurities,
satisfying the following formula (i), wherein a metal micro-structure is consisting essentially of an austenite single phase, V carbides having circle equivalent diameters of 5 to 100 nm exist at a number density of 20 pieces/$\mu m^2$ or higher, and a yield strength is 654 MPa or higher;

$$0.6 \leq C-0.18V-0.06Cr < 1.44 \quad \text{(i)}$$

where, the symbol of an element in the formula represents the content (mass %) of the element contained in the steel material, and is made zero in the case where the element is not contained.

(2) The high-strength steel material for oil well according to (1), wherein the chemical composition contains, by mass percent, one or two elements selected from
Cr: 0.1 to 2.0% and
Mo: 0.1 to 3.0%.

(3) The high-strength steel material for oil well according to (1) or (2), wherein the chemical composition contains, by mass percent, one or two elements selected from
Cu: 0.1 to 1.5% and
Ni: 0.1 to 1.5%.

(4) The high-strength steel material for oil well according to any one of (1) to (3), wherein the chemical composition contains, by mass percent, one or more elements selected from
Nb: 0.005 to 0.5%,
Ta: 0.005 to 0.5%,
Ti: 0.005 to 0.5% and
Zr: 0.005 to 0.5%.

(5) The high-strength steel material for oil well according to any one of (1) to (4), wherein the chemical composition contains, by mass percent, one or two elements selected from
Ca: 0.0003 to 0.005% and
Mg: 0.0003 to 0.005%.

(6) The high-strength steel material for oil well according to any one of (1) to (5), wherein the chemical composition contains, by mass percent, B: 0.0001 to 0.015%.

(7) The high-strength steel material for oil well according to any one of (1) to (6), wherein the yield strength is 758 MPa or higher.

(8) Oil country tubular goods, which are comprised of the high-strength steel material for oil well according to any one of (1) to (7).

Advantageous Effects of the Invention

According to the present invention, a steel material is essentially composed of austenite structure and thus has an excellent SSC resistance in DCB test, and has a high yield strength of 654 MPa or higher by utilizing precipitation strengthening. Therefore, the high-strength steel material for oil well according to the present invention can be used suitably for oil country tubular goods in wet hydrogen sulfide environments.

MODE FOR CARRYING OUT THE INVENTION

Figure 1:
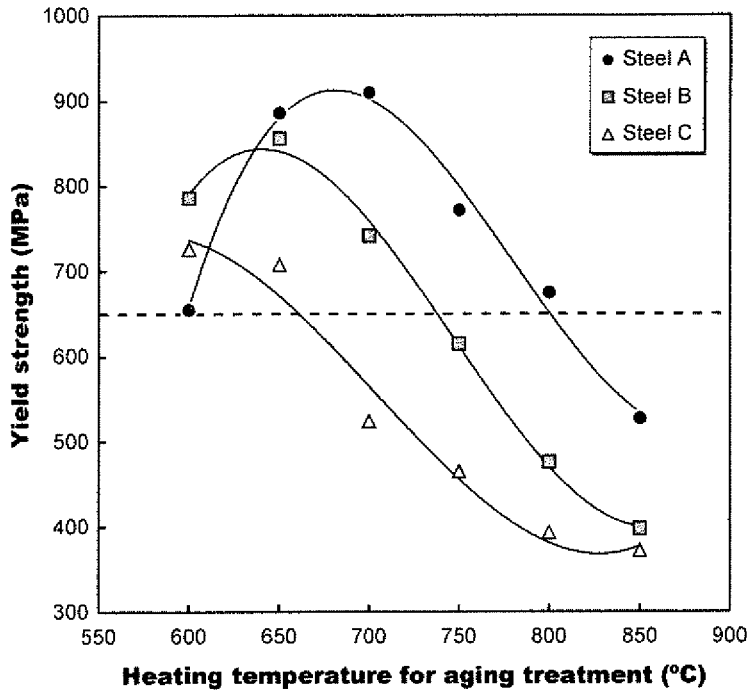
FIG. 1 is a graph showing the relationship between heating temperatures for aging treatment and yield strengths.

Components of the present invention is described below in detail.

1. Chemical Composition

The reasons for restricting the elements are as described below. In the following explanation, the symbol "%" for the content of each element means "% by mass".

C: 0.70 to 1.8%

Carbon (C) has an effect of stabilizing austenite phase at a low cost even if the content of Mn or Ni is reduced, and also can improve the work hardening property and uniform elongation by means of promotion of plastic deformation by twinning, so that C is a very important element in the present invention. The steel of the present invention is intended to be strengthened by performing an aging heat treatment and precipitating carbides. Since C is consumed to form carbides at the time, it is necessary to adjust the C content considering the amount of C consumed as carbides. Therefore, 0.70% or more of C has to be contained. On the other hand, if the content of C is too high, cementite precipitates, and thereby not only the grain boundary strength is decreased and the stress corrosion cracking susceptibility is increased, but also the fusing point of material is decreased remarkably and the hot workability is deteriorated. Therefore, the C content is set to 1.8% or less. In order to obtain the high-strength steel material for oil well excellent in balance of strength and elongation, the C content is preferably more than 0.80%, further preferably 0.85% or more. Also, the C content is preferably 1.6% or less, further preferably 1.3% or less.

Si: 0.05 to 1.00%

Silicon (Si) is an element necessary for deoxidation of steel. If the content of Si is less than 0.05%, the deoxidation is insufficient and many nonmetallic inclusions remain, and therefore desired SSC resistance cannot be achieved. On the other hand, if the content of Si is more than 1.00%, the grain boundary strength is weakened, and the SSC resistance is decreased. Therefore, the content of Si is set to 0.05 to 1.00%. The Si content is preferably 0.10% or more, further preferably 0.20% or more. Also, the Si content is preferably 0.80% or less, further preferably 0.60% or less.

Mn: 12.0 to 25.0%

Manganese (Mn) is an element capable of stabilizing austenite phase at a low cost. In order to exert the effect in the present invention, 12.0% or more of Mn has to be contained. On the other hand, Mn dissolves preferentially in wet hydrogen sulfide environments, and stable corrosion products are not formed on the surface of material. As a result, the general corrosion resistance is deteriorated with the increase in the Mn content. If more than 25.0% of Mn is contained, the corrosion rate becomes higher than the standard corrosion rate of low-alloy oil country tubular goods. Therefore, the Mn content has to be set to 25.0% or less. The Mn content is preferably 13.5% or more, further preferably 16.0% or more. Also, the Mn content is preferably 22.5% or less.

In the present invention, the "standard corrosion rate of low-alloy oil country tubular goods" means a corrosion rate converted from the corrosion loss at the time when a steel is immersed in solution A (5% NaCl+0.5% $CH_3COOH$ aqueous solution, 1-bar $H_2S$ saturated) specified in NACE TM0177-2005 for 336 h, being 1.5 g/($m^2$·h).

Al: 0.003 to 0.06%

Aluminum (Al) is an element necessary for deoxidation of steel, and therefore 0.003% or more of Al has to be contained. However, if the content of Al is more than 0.06%, oxides are liable to be mixed in as inclusions, and the oxides may exert an adverse influence on the toughness and corrosion resistance. Therefore, the Al content is set to 0.003 to 0.06%. The Al content is preferably 0.008% or more, further preferably 0.012% or more. Also, the Al content is preferably 0.05% or less, further preferably 0.04% or less. In the present invention, Al means acid-soluble Al (sol.Al).

P: 0.03% or less

Phosphorus (P) is an element existing unavoidably in steel as an impurity. However, if the content of P is more than 0.03%, P segregates at grain boundaries, and deteriorates the SSC resistance. Therefore, the content of P has to be set to 0.03% or less. The P content is desirably as low as possible, being preferably 0.02% or less, further preferably 0.012% or less. However, an excessive decrease in the P content leads to a rise in production cost of steel material. Therefore, the lower limit of the P content is preferably 0.001%, further preferably 0.005%.

S: 0.03% or less

Sulfur (S) exists unavoidably in steel as an impurity like P. If the content of S is more than 0.03%, S segregates at grain boundaries and forms sulfide-based inclusions, and therefore deteriorates the SSC resistance. Therefore, the content of S has to be set to 0.03% or less. The S content is desirably as low as possible, being preferably 0.015% or less, further preferably 0.01% or less. However, an excessive decrease in the S content leads to a rise in production cost of steel material. Therefore, the lower limit of the S content is preferably 0.001%, further preferably 0.002%.

N: 0.10% or less

Nitrogen (N) is usually handled as an impurity element in iron and steel materials, and is decreased by denitrification. Since N is an element for stabilizing austenite phase, a large amount of N may be contained to stabilize austenite. However, since the present invention intends to stabilize austenite by means of C and Mn, N need not be contained positively. Also, if N is contained excessively, the high-temperature strength is raised, the work stress at high temperatures is increased, and the hot workability is deteriorated. Therefore, the content of N has to be set to 0.10% or less. The N content is preferably 0.07% or less, further preferably 0.04% or less. From the viewpoint of refining cost, denitrification need not be accomplished unnecessarily, so that the lower limit of the N content is preferably 0.0015%.

V: more than 0.5% and 2.0% or less

Vanadium (V) is an element that strengthen the steel material by performing heat treatment at an appropriate temperature and time and thereby precipitating fine carbides ($V_4C_3$) in the steel, and therefore more than 0.5% of V has to be contained. However, if V is contained excessively, the effect is saturated and a large amount of C, which stabilize an austenite phase is consumed. Therefore, the content of V is set to more than 0.5% and 2.0% or less. In order to assure sufficient strength the V content is preferably 0.6% or more, more preferably 0.7% or more. Also, the V content is preferably 1.8% or less, more preferably 1.6% or less.

Cr: 0 to 2.0%

Chromium (Cr) may be contained as necessary because it is an element for improving the general corrosion resistance. However, if Cr is contained excessively, the SSC resistance is deteriorated. Further, the stress corrosion cracking resistance (SCC resistance) can be deteriorated, and stability of austenite can be disturbed by consuming C in a base metal to form carbides during an aging heat treatment. Therefore, the content of C is set to 2.0% or less. Also, when the Cr content is high, it is necessary to set a solid solution heat treatment temperature to higher temperature, leading to economic disadvantage. Thus, the Cr content is preferably 0.8% or less, further preferably 0.4% or less. In the case where it is desired to achieve the above-described effect, the Cr content is preferably set to 0.1% or more, further preferably set to 0.2% or more, and still further preferably set to 0.5% or more.

Mo: 0 to 3.0%

Molybdenum (Mo) may be contained as necessary because it is an element for stabilizing corrosion products in wet hydrogen sulfide environments and for improving the general corrosion resistance. However, if the content of Mo is more than 3.0%, the SSC resistance and SCC resistance can be deteriorated. Also, since Mo is a very expensive element, the content of Mo is set to 3.0% or less. In the case where it is desired to achieve the above-described effect, the Mo content is preferably set to 0.1% or more, further preferably set to 0.2% or more, and still further preferably set to 0.5% or more.

Cu: 0 to 1.5%

Copper (Cu) may be contained as necessary, if in a small amount, because it is an element capable of stabilizing austenite phase. However, in the case where the influence on the corrosion resistance is considered, Cu is an element that promotes local corrosion, and is liable to form a stress concentrating zone on the surface of steel material. Therefore, if Cu is contained excessively, the SSC resistance and SCC resistance can be deteriorated. For this reason, the content of Cu is set to 1.5% or less. The Cu content is preferably 1.0% or less. In the case where it is desired to achieve the effect of stabilizing austenite, the Cu content is preferably set to 0.1% or more, further preferably set to 0.2%© or more.

Ni: 0 to 1.5%

Nickel (Ni) may be contained as necessary, if in a small amount, because it is an element capable of stabilizing austenite phase as is the case with Cu. However, in the case where the influence on the corrosion resistance is considered, Ni is an element that promotes local corrosion, and is liable to form a stress concentrating zone on the surface of steel material. Therefore, if Ni is contained excessively, the SSC resistance and SCC resistance can be deteriorated. For this reason, the content of Ni is set to 1.5% or less. The Ni content is preferably 1.0% or less. In the case where it is desired to achieve the effect of stabilizing austenite, the Ni content is preferably set to 0.1% or more, further preferably set to 0.2% or more.

Nb: 0 to 0.5%

Ta: 0 to 0.5%

Ti: 0 to 0.5%

Zr: 0 to 0.5%

Niobium (Nb), tantalum (Ta), titanium (Ti) and zirconium (Zr) may be contained as necessary because these are elements that contribute to the strength of the steel by combining with C or N to form micro carbides or carbonitrides. However, the effect of strengthening by forming carbides or carbonitrides of these elements is limited compared to that of V. Also, if these elements are contained excessively, the effect is saturated and deterioration of toughness and destabilization of austenite can be caused. Therefore, the content of each element is 0.5% or less and preferably 0.35% or less. In order to obtain the effect, the content of one or more elements selected from these elements is preferably 0.005% or more, further preferably 0.05% or more.

Ca: 0 to 0.005%

Mg: 0 to 0.005%

Calcium (Ca) and magnesium (Mg) may be contained as necessary because these are elements that have effects to improve toughness and corrosion resistance by controlling the form of inclusions, and further enhance casting properties by suppressing nozzle clogging during casting. However, if these elements are contained excessively, the effect is saturated and the inclusions are liable to be clustered to deteriorate toughness and corrosion resistance. Therefore, the content of each element is 0.005% or less. The content of each element is preferably 0.003% or less. When both Ca and Mg are contained the total content of these elements is preferable 0.005% or less. In order to obtain the effect, the content of one or two elements from these elements is preferably 0.0003% or more, further preferably 0.0005% or more.

B: 0 to 0.015%

Boron (B) may be contained as necessary because this is an element that has effects to refine the precipitates and the austenite grain size. However, if B is contained excessively, low-melting-point compounds can be formed to deteriorate hot workability. Especially, if the B content is more than 0.015%, the hot workability can be deteriorated remarkably. Therefore, the B content is 0.015% or less. In order to obtain the effect, the B content is preferably 0.0001% or more.

The high-strength steel material for oil well of the present invention has the chemical composition consisting of the elements ranging from C to B, the balance being Fe and impurities.

The term "impurities" means components that are mixed in on account of various factors in the production process including raw materials such as ore and scrap when the steel is produced on an industrial basis, which components are allowed in the range in which the components does not exert an adverse influence on the present invention.

$$0.6 \leq C-0.18V-0.06Cr < 1.44 \quad \text{(i)}$$

where the symbols of elements in the formula each represent the content of each element (mass %) contained in the steel material and is each made zero in the case where the element is not contained.

In the present invention, although the C content is regulated within the above-described range in order to stabilize an austenite phase, since a steel material is strengthened by precipitating V carbides or carbonitrides, there is a risk that part of C is consumed, austenite stability is decreased. The most C is consumed when whole V is precipitated as carbides. In addition, C is also consumed by precipitation of Cr carbides in the case where Cr is contained.

Assuming that V carbides are all $V_4C_3$ and Cr carbides are all $Cr_{23}C_6$, an effective amount of C that contributes to the stabilization of austenite is expressed by C-0.18V−0.06Cr as shown in the formula (i), and it is necessary to adjust the contents of C, V and Cr such that the effective amount of C is 0.6 or more in order to attain stabilization of austenite. On the other hand, an effective amount of C of 1.44 or more poses problems of the inhomogeneity of a micro-structure and the deterioration in hot workability with the formation of cementite, and it is necessary to adjust the contents of C, V and Cr such that the effective amount of C is less than 1.44. The effective amount of C is preferably 0.65 or more, more preferably 0.7 or more. Also, the effective amount of C is preferably 1.4 or less, more preferably 1.3 or less, further preferably 1.15% or less.

$$Mn \geq 3C+10.6 \quad \text{(ii)}$$

where the symbols of elements in the formula each represent the content of each element (mass %) contained in the steel material.

As described above, the present invention intend to strengthen the steel by performing an aging treatment and precipitating carbides. However, if pearlite transformation occurs during an aging treatment, the corrosion resistance can be remarkably decreased. Mn and C are elements that have an effect on a temperature for forming pearlite, and in the case where the formula (ii) in the relation of both elements is not satisfied, there is a risk that pearlite transformation occurs depending on an aging treatment condition. Therefore, it is desirable to satisfy the formula (ii).

2. Metal Micro-Structure

As described above, if α' martensite and ferrite each having a BCC structure are intermixed in the metal micro-structure, the SSC resistance is deteriorated. Therefore, in the present invention, the metal micro-structure consists essentially of an austenite single phase.

In the present invention, as a structure consisting essentially of an austenite single phase, the intermixing of α' martensite and ferrite of less than 0.1%, by total volume fraction, besides an FCC structure serving as a matrix of steel is allowed. And also the intermixing of c martensite of an HCP structure is allowed. The volume fraction of c martensite is preferably 10% or less, more preferably 2% or less.

Since the α' martensite and ferrite exist in the metal micro-structure as fine crystals, it is difficult to measure the volume fraction thereof by means of X-ray diffraction, microscope observation or the like. Therefore, in the present invention, the total volume fraction of the structure having a BCC structure is measured by using a ferrite meter.

As described above, steel materials of an austenite single phase generally have low strengths. For this reason, in the present invention, a steel material is strengthened by, in particular, the precipitation of V carbides. V carbides are precipitated inside the steel material and make a dislocation difficult to move, which contributes to the strengthening. If V carbides have circle-equivalent diameters of less than 5 nm, they do not serve as obstructions to the movement of a dislocation. On the other hand, if V carbides become coarse to have a size of 100 nm in terms of circle-equivalent diameter, the number of V carbides extremely decreases, and thus the V carbides do not contribute to the strengthening. Therefore, the sizes of carbides suitable to subject a steel material to precipitation strengthening are 5 to 100 nm.

In order to obtain a yield strength of 654 MPa or higher in a stable manner, it is required that the V carbides having circle-equivalent diameters of 5 to 100 nm exist, in a steel micro-structure, at a number density of 20 pieces/$\mu m^2$ or higher. The method for measuring the number density of V carbides is not subject to any special restriction, but for example, the measurement can be carried out by the following method. A thin film having a thickness of 100 nm is prepared from the inside of a steel material (central portion of wall thickness), the thin film is observed using a transmission electron microscope (TEM), and the number of V carbides having the circle-equivalent diameter of 5 to 100 run, included in a visual field of 1 μm square, is counted. It is desirable that the measurement of the number density is carried out in a plurality of visual fields, and the average value thereof is calculated. If it is desired to achieve a yield strength of 689 MPa or higher, V carbides having circle-equivalent diameters of 5 to 100 nm desirably exist at a number density of 50 pieces/$\mu m^2$ or higher.

3. Mechanical Properties

At a strength level less than 654 MPa, even typical low-alloy steels can ensure sufficient SSC resistances. However, as described above, since the SSC resistance drastically decreases with the increase in the strength of a steel, the combination of a high strength and an excellent SSC resistance is difficult to be achieved by a low-alloy steel. Thus, in the present invention, a yield strength is limited to 654 MPa or higher. The steel material according to the present invention can achieve the combination of a high yield strength of 654 MPa or higher and an excellent SSC resistance in DCB test. To enhance the above-described advantage, the yield strength of the high-strength steel material for oil well according to the present invention is preferably 689 MPa or higher, more preferably, 758 MPa or higher.

In the present invention, being excellent in SSC resistance in DCB test means that a value of $K_{ISSC}$ calculated in DCB test specified in NACE TM0177-2005 is 35 MPa/$m^{0.5}$ or more, 4. Production Method The method for producing the steel material according to the present invention is not subject to any special restriction as far as the above-described strength can be given by the method. For example, the method described below can be employed.

<Melting and Casting>

Concerning melting and casting, a method carried out in the method for producing general austenitic steel materials can be employed, and either ingot casting or continuous casting can be used. In the case where seamless steel pipes are produced, a steel may be cast into a round billet form for pipe making by round continuous casting.

<Hot Working (Forging, Piercing, Rolling)>

After casting, hot working such as forging, piercing, and rolling is performed. In the production of seamless steel pipes, in the case where a circular billet is cast by the round continuous casting, processes of forging, blooming, and the like for forming the circular billet are unnecessary. In the case where the steel material is a seamless steel pipe, after the piercing process, rolling is performed by using a mandrel mill or a plug mill. Also, in the case where the steel material is a plate material, the process is such that, after a slab has been rough-rolled, finish rolling is performed. The desirable conditions of hot working such as piercing and rolling are as described below.

The heating of billet may be performed to a degree such that hot piercing can be performed on a piercing-rolling mill; however, the desirable temperature range is 1000 to 1250° C. The piercing-rolling and the rolling using a mill such as a mandrel mill or a plug mill are also not subject to any special restriction. However, from the viewpoint of hot workability, specifically, to prevent surface defects, it is desirable to set the finishing temperature at 900° C. or higher. The upper limit of finishing temperature is also not subject to any special restriction; however, the finishing temperature is preferably 1100° C. or lower.

In the case where a steel plate is produced, the heating temperature of a slab or the like is enough to be in a temperature range in which hot rolling can be performed, for example, in the temperature range of 1000 to 1250° C. The pass schedule of hot rolling is optional. However, considering the hot workability for reducing the occurrence of surface defects, edge cracks, and the like of the product, it is desirable to set the finishing temperature at 900° C. or higher. The finishing temperature is preferably 1100° C. or lower as in the case of seamless steel pipe.

<Solid Solution Heat Treatment>

The steel material having been hot-worked is heated to a temperature enough for carbides and the like to be dissolved completely, and thereafter is rapidly cooled. In this case, the steel material is rapidly cooled after being held in the temperature range of 1000 to 1200° C. for 10 min or longer. If the solid solution heat treatment temperature is lower than 1000° C., V carbides cannot be dissolved completely, so that in some cases, it is difficult to obtain a yield strength of 654 MPa or higher because of insufficient precipitation strengthening. On the other hand, if the solid solution heat treatment temperature is higher than 1200° C., in some cases, a heterogeneous phase of ferrite and the like, where SSC tends to be generated, is precipitated. Also, if the holding time is shorter than 10 min, the effect of solutionizing is insufficient, so that in some cases, desired high strength, that is, yield strength of 654 MPa or higher cannot be attained.

The upper limit of the holding time depends on the size and shape of steel material, and cannot be determined unconditionally. Anyway, the time for soaking the whole of steel material is necessary. From the viewpoint of reducing the production cost, too long time is undesirable, and it is proper to usually set the time within 1 h. Also, in order to prevent carbides, other intermetallic compounds, and the like from precipitating during cooling, the steel material is desirably cooled at a cooling rate higher than the oil cooling rate.

The above-described lower limit value of the holding time is holding time in the case where the steel material is reheated to the temperature range of 1000 to 1200° C. after the steel material having been hot-worked has been cooled once to a temperature lower than 1000° C. However, in the case where the finish temperature of hot working (finishing temperature) is made in the range of 1000 to 1200° C., if supplemental heating is performed at that temperature for 5 min or longer, the same effect as that of solid solution heat treatment performed under the above-described conditions can be achieved, so that rapid cooling can be performed as it is without reheating. Therefore, the lower limit value of the holding time in the present invention includes the case where the finish temperature of hot working (finishing temperature) is made in the range of 1000 to 1200° C., and supplemental heating is performed at that temperature for 5 min or longer.

<Age-Hardening Treatment>

The steel material having been solid solution heat treated is subjected to aging Treatment in order to enhance the strength of the steel by precipitating V carbides finely. The effect of aging treatment (age-hardening) depends on heating temperature and holding time at the heating temperature. Basically, the higher a heating temperature is, the shorter a holding time required is. And so heating treatment at low temperature requires long holding time. Therefore, heating temperature and holding time can be adjusted appropriately so as to obtain desired strength. As a heating treatment condition, it is preferable to hold the steel in the temperature range of 600 to 800° C. for 30 min or longer.

If the heating temperature for aging treatment is lower than 600° C., precipitation of V carbides becomes insufficient, making it difficult to assure yield strength of 654 MPa or higher. On the other hand, if the heating temperature is higher than 800° C., V carbides are easily dissolved and cannot be precipitated. Therefore, the above described yield strength cannot be attained.

Also, if the holding time for aging treatment is shorter than 30 min, precipitation of V carbides becomes insufficient, making it difficult to assure the above described yield strength. The upper limit of the holding time is not limited, but it is appropriate to be 7 h or shorter. It wastes energy to keep the heat after the effect of precipitation hardening is saturated. The steel material having been aging treated may be allowed to cool.

Hereunder, the present invention is explained more specifically with reference to examples; however, the present invention is not limited to these examples.

Example 1

Twenty-two kinds of steels of A to N and AA to AH having the chemical compositions given in Table 1 were melted in a 50 kg vacuum furnace to produce ingots. Each of the ingots was heated at 1180° C. for 3 h, and thereafter was forged and cut by electrical discharge cutting-off. Thereafter, the cut ingot was further soaked at 1150° C. for 1 h, and was hot-rolled into a plate material having a thickness of 20 mm. Further, the plate material was subjected to solid solution heat treatment (water cooling after the heat treatment) at 1100° C. for 1 h. Subsequently, the age-hardening treatment was performed under the conditions shown in Table 2 to obtain a test material.

For steels A to C, a plurality of samples were prepared and subjected to aging treatment under the various temperature conditions of 600 to 850° C., aside from the treatment under the condition shown in Table 2, in order to investigate the relationship between heating temperature for aging treatment and yield strength. The holding time for aging treatment was 3 h for steel A, 10 h for steel B and 20 h for steel C regardless of heating temperature.

Steels AI and AJ having the chemical compositions given in Table 1 were conventional low-alloy steels, which were prepared for comparison. Two kinds of the steels were melted in a 50 kg vacuum furnace to produce ingots. Each of the ingots was heated at 1180° C. for 3 h, and thereafter was forged and cut by electrical discharge cutting-off. Thereafter, the cut ingot was further soaked at 1150° C. for 1 h, and was hot-rolled into a plate material having a thickness of 20 mm. Further, the plate material was subjected to quenching treatment in which the plate material was held at 950° C. for 15 min and then cooled rapidly. Subsequently, the plate material was subjected to tempering treatment in which the plate material was held at 705° C. to obtain a test material.

[Table 1]

TABLE 1

| Steel | Chemical composition (in mass %, balance: Fe and impurities) | | | | | | | | | | |
|---|---|---|---|---|---|---|---|---|---|---|---|
| | C | Si | Mn | Al | P | S | N | V | Cr | Mo | Cu |
| A | 1.41 | 0.29 | 16.13 | 0.018 | 0.012 | 0.004 | 0.021 | 1.78 | — | — | — |
| B | 1.02 | 0.31 | 17.95 | 0.033 | 0.011 | 0.004 | 0.018 | 1.02 | — | — | — |
| C | 0.75 | 0.33 | 20.08 | 0.029 | 0.014 | 0.005 | 0.016 | 0.54 | — | — | — |
| D | 0.91 | 0.16 | 18.11 | 0.019 | 0.011 | 0.005 | 0.015 | 0.79 | 0.98 | — | — |
| E | 0.89 | 0.13 | 17.86 | 0.025 | 0.011 | 0.006 | 0.013 | 0.81 | — | 0.94 | — |
| F | 0.93 | 0.14 | 17.98 | 0.020 | 0.009 | 0.006 | 0.022 | 0.81 | — | — | 0.44 |
| G | 1.22 | 0.24 | 22.07 | 0.013 | 0.010 | 0.004 | 0.014 | 1.19 | — | — | — |
| H | 1.17 | 0.25 | 21.98 | 0.018 | 0.010 | 0.007 | 0.016 | 1.20 | — | — | — |
| I | 1.18 | 0.22 | 21.84 | 0.017 | 0.012 | 0.006 | 0.019 | 1.23 | — | — | — |
| J | 1.01 | 0.40 | 14.10 | 0.031 | 0.011 | 0.008 | 0.064 | 1.03 | — | — | — |
| K | 0.97 | 0.39 | 13.86 | 0.025 | 0.010 | 0.007 | 0.040 | 1.02 | 0.52 | 0.46 | — |
| L | 1.03 | 0.37 | 13.77 | 0.033 | 0.011 | 0.008 | 0.023 | 0.98 | — | — | — |
| M | 1.26 | 0.51 | 18.10 | 0.022 | 0.013 | 0.006 | 0.021 | 1.92 | — | — | 0.89 |
| N | 1.25 | 0.50 | 17.92 | 0.021 | 0.014 | 0.006 | 0.015 | 1.96 | — | — | — |
| AA | 0.59 * | 0.25 | 18.02 | 0.019 | 0.011 | 0.006 | 0.033 | 0.58 | — | — | — |
| AB | 0.75 | 0.24 | 13.14 | 0.022 | 0.012 | 0.005 | 0.029 | 1.88 | — | — | — |
| AC | 0.91 | 0.27 | 8.09 * | 0.021 | 0.012 | 0.005 | 0.031 | 0.81 | — | — | — |
| AD | 0.88 | 0.34 | 28.10 * | 0.018 | 0.013 | 0.006 | 0.011 | 0.80 | — | — | — |
| AE | 0.76 | 0.33 | 14.02 | 0.026 | 0.012 | 0.004 | 0.012 | 0.40 * | — | — | — |
| AF | 0.74 | 0.33 | 13.88 | 0.025 | 0.014 | 0.006 | 0.011 | 0.71 | 4.18 * | — | — |
| AG | 0.77 | 0.35 | 14.08 | 0.021 | 0.012 | 0.007 | 0.013 | 0.79 | — | 3.95 * | — |
| AH | 1.02 | 0.35 | 15.89 | 0.018 | 0.013 | 0.004 | 0.014 | 0.77 | — | — | 1.95 * |
| AI | 0.29 * | 0.31 | 0.51 * | 0.033 | 0.010 | 0.001 | 0.005 | 0.11 * | 1.02 | 0.72 | — |
| AJ | 0.31 * | 0.30 | 0.48 * | 0.026 | 0.010 | 0.001 | 0.004 | 0.12 * | 1.21 | 0.99 | — |

| Steel | Chemical composition (in mass %, balance: Fe and impurities) | | | | | | | | | |
|---|---|---|---|---|---|---|---|---|---|---|
| | Ni | Nb | Ta | Ti | Zr | Ca | Mg | B | C—0.18V—0.06Cr | 3C + 10.6 |
| A | — | — | — | — | — | — | — | — | 1.09 | 14.83 |
| B | — | — | — | — | — | — | — | — | 0.84 | 13.66 |
| C | — | — | — | — | — | — | — | — | 0.65 | 12.85 |
| D | — | — | — | — | — | 0.002 | — | — | 0.71 | 13.33 |
| E | — | — | — | — | — | 0.002 | — | — | 0.74 | 13.27 |
| F | 0.48 | — | — | — | — | 0.003 | — | — | 0.78 | 13.39 |
| G | — | 0.29 | — | 0.19 | — | — | — | — | 1.01 | 14.26 |
| H | — | — | 0.27 | — | — | — | 0.002 | — | 0.95 | 14.11 |
| I | — | — | — | — | 0.21 | — | 0.002 | — | 0.96 | 14.14 |
| J | — | — | — | — | — | — | — | — | 0.82 | 13.63 |
| K | — | — | — | — | — | — | — | 0.001 | 0.76 | 13.51 |
| L | — | — | — | — | — | — | — | — | 0.85 | 13.69 |
| M | — | — | — | — | — | — | — | — | 0.91 | 14.38 |
| N | — | — | — | — | — | — | — | — | 0.90 | 14.35 |
| AA | — | — | — | — | — | — | — | — | 0.49 * | 12.37 |
| AB | — | — | — | — | — | — | — | — | 0.41 * | 12.85 |
| AC | — | — | — | — | — | — | — | — | 0.76 | 13.33 |
| AD | — | — | — | — | — | — | — | — | 0.74 | 13.24 |
| AE | — | — | — | — | — | — | — | — | 0.69 | 12.88 |
| AF | — | — | — | — | — | — | — | — | 0.36 * | 12.82 |
| AG | — | — | — | — | — | — | — | — | 0.63 | 12.91 |
| AH | 1.98 * | — | — | — | — | — | — | — | 0.88 | 13.66 |
| AI | — | 0.03 | — | — | — | — | — | — | 0.21 * | 11.47 |
| AJ | — | 0.03 | — | — | — | — | — | — | 0.22 * | 11.53 |

* indicates that conditions do not satisfy those defined by the present invention.

TABLE 2

| Test No. | Steel | Aging treatment condition: Heating temperature (° C.) | Holding time (h) | The number density of V carbides (pieces/μm$^2$) | Yield strength (MPa) | $K_{ISSC}$ (MPa · m$^{0.5}$) | Corrosion rate (g/m$^2$/h) | SCC resistance | |
|---|---|---|---|---|---|---|---|---|---|
| 1 | A | 700 | 3 | >50 | 910 | 47.2 | 1.1 | ○ | Inventive example |
| 2 | B | 650 | 10 | >50 | 833 | 39.1 | 1.2 | ○ | |
| 3 | C | 650 | 20 | >50 | 708 | 36.9 | 1.4 | ○ | |
| 4 | D | 650 | 10 | >50 | 791 | 36.8 | 1.4 | ○ | |
| 5 | E | 650 | 10 | >50 | 809 | 37.1 | 1.3 | ○ | |
| 6 | F | 650 | 10 | >50 | 798 | 36.6 | 1.4 | ○ | |
| 7 | G | 700 | 3 | >50 | 832 | 46.2 | 1.2 | ○ | |
| 8 | H | 700 | 3 | >50 | 821 | 44.1 | 1.2 | ○ | |
| 9 | I | 700 | 3 | >50 | 824 | 40.8 | 1.1 | ○ | |

TABLE 2-continued

| Test No. | Steel | Aging treatment condition: Heating temperature (° C.) | Holding time (h) | The number density of V carbides (pieces/μm$^2$) | Yield strength (MPa) | $K_{ISSC}$ (MPa · m$^{0.5}$) | Corrosion rate (g/m$^2$/h) | SCC resistance | |
|---|---|---|---|---|---|---|---|---|---|
| 10 | J | 650 | 10 | >50 | 849 | 37.8 | 1.3 | ○ | |
| 11 | K | 650 | 10 | >50 | 833 | 36.4 | 1.4 | ○ | |
| 12 | L | 650 | 10 | >50 | 838 | 38.1 | 1.3 | ○ | |
| 13 | M | 800 | 1 | 40 | 664 | 39.1 | 1.1 | ○ | |
| 14 | N | 800 | 20 | 7 * | 610 * | 38.2 | 1.1 | ○ | Comparative |
| 15 | AA * | 650 | 10 | >50 | 667 | 33.3 | 1.3 | ○ | example |
| 16 | AB * | 700 | 3 | >50 | 810 | 33.9 | 1.2 | ○ | |
| 17 | AC * | 650 | 10 | >50 | 788 | 32.8 | 1.1 | ○ | |
| 18 | AD * | 650 | 10 | >50 | 769 | 36.3 | 1.6 | ○ | |
| 19 | AE * | 650 | 10 | 15 * | 647 * | 35.7 | 1.2 | ○ | |
| 20 | AF * | 650 | 10 | >50 | 782 | 34.8 | 1.2 | x | |
| 21 | AG * | 650 | 10 | >50 | 825 | 36.8 | 1.1 | x | |
| 22 | AH * | 650 | 10 | >50 | 842 | 37.3 | 1.1 | x | |
| 23 | AI * | — | — | — * | 745 | 30.3 | 0.9 | ○ | |
| 24 | AJ * | — | — | — * | 733 | 29.6 | 0.8 | ○ | |

* indicates that conditions do not satisfy those defined by the present invention On the obtained test materials of Nos. 1 to 22, excluding low-alloy steels, first, the total volume ratio of ferrite and α' martensite was measured by using a ferrite meter (model number: FE8e3) manufactured by Helmut Fischer, but could not be detected on all of the test specimens. The test materials were also analyzed by X-ray diffraction to measure α' martensite and E martensite. However, on all of the test specimens, the existence of these kinds of martensite could not be detected.

Also, a thin film having a thickness of 100 nm was prepared from the test material, the thin film was observed using a transmission electron microscope (TEM), and the number of V carbides having the circle-equivalent diameter of 5 to 100 urn, included in a visual field of 1 μm square, was counted.

Furthermore, from each of the steels, a round-bar tensile test specimen having a parallel part measuring 6 mm in outside diameter and 40 mm in length was sampled. A tension test was conducted at normal temperature (25° C.), whereby the yield strength YS (0.2% yield stress) (MPa) was determined.

FIG. 1 is a graph showing the relationship between heating temperatures for aging treatment and yield strengths with respect to the steels A to C. As can be seen from FIG. 1, optimum heating temperatures exist corresponding to the compositions of the steels and holding times in aging treatment. The steel A has a high V content of 1.41% and high yield strengths can be thus ensured within a wide temperature range from 600 to 800° C. even by providing an aging treatment in a short time of 3 h. In contrast, the steel C has a relatively low V content of 0.75%, but it can be seen that, a low-temperature condition, which is 650° C. or less, allows a yield strength of 654 MPa or more to be ensured by providing aging treatment in a long time of 20 h.

Subsequently, using the test materials, SSC resistance in DCB test, SSC resistance in constant load test, SCC resistance, and corrosion rate were examined.

First, to evaluate SSC resistance, the DCB test specified in NACE TM0177-2005 was conducted. The thickness of a wedge was 3.1 mm, the wedge was inserted into a test specimen before being immersed in a solution A specified in the test standard (5% NaCl+0.5% $CH_3COOH$ aqueous solution, $H_2S$ saturated at 1 bar), at 24° C. for 336 h, and thereafter, the value of $K_{ISSC}$ was calculated based on a wedge releasing stress and the length of a crack.

The SSC resistance in constant load test was evaluated as described below. A plate-shaped smooth test specimen was sampled, and a stress corresponding to 90% of yield strength was applied to one surface of the test specimen by four-point bending method. Thereafter, the test specimen was immersed in a test solution, that is, the same solution A as described above, and was held at 24° C. for 336 h. Subsequently, it was judged whether or not rupture occurred. As a result, no rupture occurs in all of the test materials.

Concerning the SCC resistance as well, a plate-shaped smooth test specimen was sampled, and a stress corresponding to 90% of yield strength was applied to one surface of the test specimen by four-point bending method. Thereafter, the test specimen was immersed in a test solution, that is, the same solution A as described above, and was held in a test environment of 60° C. for 336 h. Subsequently, it was judged whether or not rupture occurred. As the result, a not-ruptured steel material was evaluated so that the SCC resistance is good (referred to as "○" in Table 2), and a ruptured steel material was evaluated so that the SCC resistance is poor (referred to as "x" in Table 2). This test solution is a test environment less liable to produce SSC because the temperature thereof is 60° C. and thereby the saturated concentration of $H_2S$ in the solution is decreased compared with that at normal temperature. Concerning the test specimen in which cracking occurred in this test, whether this cracking is SCC or SSC was judged by observing the propagation mode of crack under an optical microscope. Concerning the specimen of this test, it was confirmed that, for all of the test specimens in which cracking occurred in the above-described test environment, SCC had occurred.

The reason why the SCC resistance was evaluated is as described below. As one kind of environment cracks of oil country tubular goods occurring in the oil well, inherently, attention must be paid to SCC (stress corrosion cracking). The SCC is a phenomenon in which cracks are propagated by local corrosion, and is caused by partial fracture of the protection film on the surface of material, grain-boundary segregation of alloying element, and the like. Conventionally, low alloy steel oil country tubular goods having a tempered martensitic microstructure have scarcely been studied from the view point of the SCC resistance because the corrosion of those advances wholly, and the excessive adding of alloying element that brings about grain-boundary segregation leads to the deterioration in SSC resistance. Further, sufficient findings have not necessarily been obtained concerning the SCC susceptibility of a steel equivalent or similar to the steel material of the present invention, which has a component system vastly different from that of low-alloy steel, and has austenitic structure. Therefore, an influence of component on the SCC susceptibility and the like must be clarified.

Also, to evaluate the general corrosion resistance, the corrosion rate was determined by the method described below. The above-described test material was immersed in the solution A at normal temperature for 336 h, the corrosion loss was determined, and the corrosion loss was converted into the average corrosion rate. In the present invention, the test material that showed the corrosion rate of 1.5 g/($m^2$·h) or lower was evaluated so that the general corrosion resistance is good.

These results are collectively given in Table 2. From Table 2, it can be seen that for Test Nos. 1 to 13, which are example embodiments of the present invention, a yield strength of 654 MPa or higher and a value of $K_{ISSC}$ calculated in DCB test of 35 MPa/$m^{0.5}$ or more can be provided. Also, the SCC resistance is excellent, and the corrosion rate can be kept at 1.5 g/($m^2$·h), which is the target value, or lower.

On the other hand, for Test No. 14, which is comparative example, the precipitation of V carbides was insufficient and a number density was 7 pieces/$\mu m^2$, which was lower than the lower limit defined in the present invention because the condition of aging treatment was inappropriate, specifically, the heating temperature was too high and the holding time was too long, although the chemical composition satisfied the definition of the present invention. Consequently the yield strength was 610 MPa and the target strength cannot be attained.

Also, for Test Nos. 15 to 17 in which the effective amount of C or the Mn content was less than the lower limits defined in the present invention, the test result was such that a value of $K_{ISSC}$ was lower than 35 MPa/$m^{0.5}$ and the SSC resistance in DCB test was poor. It is presumed that the result was due to the formation of α' martensite in the region of a crack front end caused by the decrease of austenite stability because of the poverty of the effective amount of C or the Mn content. For Test No. 18 in which the Mn content was more than the defined upper limit, the test result was such that, although the SSC resistance in DCB test was good, the corrosion rate was high, and the general corrosion resistance was poor.

Further, for Test No. 19 in which the V content was less than the defined lower limit, the test result was such that the precipitation of V carbides was insufficient and the number density was 15 pieces/$\mu m^2$, which was lower than the lower limit defined in the present invention. Consequently the effect of precipitation strengthening was insufficient and the target strength cannot be attained. For Test No. 20 in which the Cr content was high and thus the effective amount of C was out of the defined range, the test result was such that a value of $K_{ISSC}$ was lower than 35 MPa/$m^{0.5}$ and also the SCC resistance was poor. And, for Test No. 21 in which the Mo content was out of the defined range and Test No. 22 in which the contents of Cu and Ni were out of the defined ranges, the test results were such that the SCC resistance were poor.

Figure 2:
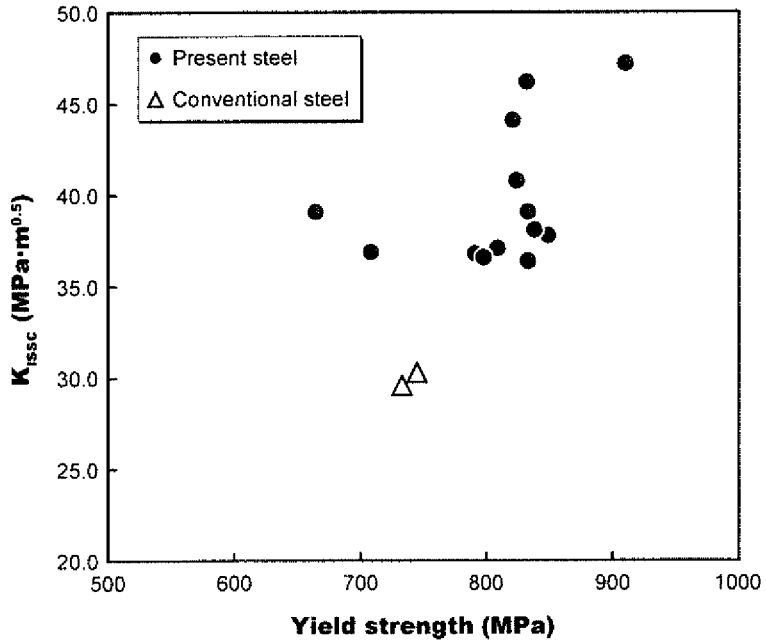
FIG. 2 is a graph showing the relationship between yield strengths and values of $K_{ISSC}$ calculated by DCB test.

FIG. 2 is a graph showing the relationship between yield strengths and values of $K_{ISSC}$ calculated by DCB test with respect to Test Nos. 1 to 13 satisfying the definition of the present invention, and Test Nos. 23 and 24, which are conventional low-alloy steels. It can be seen that the steel material according to the present invention has a high strength which is equal to or larger than that of the conventional low-alloy steel, and is extremely excellent in SSC resistance in DCB test.

INDUSTRIAL APPLICABILITY

According to the present invention, a steel material is composed essentially of austenite structure and thus has an excellent SSC resistance in DCB test, and has a high yield strength of 654 MPa or higher by utilizing precipitation strengthening. Therefore, the high-strength steel material for oil well according to the present invention can be used suitably for oil country tubular goods in wet hydrogen sulfide environments.

What is claimed is:

1. A high-strength steel material for oil well having a chemical composition consisting, by mass percent, of C: 0.70 to 1.8%,
Si: 0.05 to 1.00%,
Mn: 12.0 to 25.0%,
Al: 0.003 to 0.06%,
P: 0.03% or less,
S: 0.03% or less,
N: 0.10% or less,
V: more than 0.5% and 2.0% or less,
Cr: 0 to 2.0%,
Mo: 0 to 3.0%,
Cu: 0 to 1.5%,
Ni: 0 to 1.5%,
Nb: 0 to 0.5%,
Ta: 0 to 0.5%,
Ti: 0 to 0.5%,
Zr: 0 to 0.5%,
Ca: 0 to 0.005%,
Mg: 0 to 0.005%,
B: 0 to 0.015%,
the balance: Fe and impurities,
satisfying the following formula (i),
wherein a metal microstructure consists of an austenite single phase with a total volume fraction of α' martensite and ferrite being less than 0.1%, and a volume fraction of ε martensite being 10% or less,
V carbides having circle equivalent diameters of 5 to 100 nm exist at a number density of 20 pieces/$\mu m^2$ or higher, and
a yield strength is 654 MPa or higher;

$$0.6 \leq C-0.18V-0.06Cr < 1.44 \quad (i)$$

where, the symbol of an element in the formula represents a content in mass % of the element contained in the high-strength steel material, and is made zero in a case where the element is not contained.

2. The high-strength steel material for oil well according to claim 1,
wherein the yield strength is 758 MPa or higher.

3. Oil country tubular goods, which are comprised of the high-strength steel material for oil well according to claim 1.

4. Oil country tubular goods, which are comprised of the high-strength steel material for oil well according to claim 2.

* * * * *